United States Patent [19]

Kawamura et al.

[11] Patent Number: 4,525,622

[45] Date of Patent: Jun. 25, 1985

[54] CERAMIC GLOW PLUG

[75] Inventors: Hideo Kawamura, Kanagawa; Nobukazu Sagawa; Noriyoshi Yamamoto, both of Kagoshima, all of Japan

[73] Assignees: Isuzu Motor, Ltd., Tokyo; Kyoto Ceramic Co., Ltd., Kyoto, both of Japan

[21] Appl. No.: 574,637

[22] Filed: Jan. 30, 1984

Related U.S. Application Data

[63] Continuation of Ser. No. 335,422, Dec. 29, 1981, abandoned.

[30] Foreign Application Priority Data

Dec. 29, 1980 [JP] Japan ..... 55-188940[U]

[51] Int. Cl.[3] ..... F23Q 7/22

[52] U.S. Cl. ..... 219/270; 123/145 A; 219/541; 219/544; 219/553; 338/286; 338/269; 361/266

[58] Field of Search ..... 219/267, 270, 553, 541, 219/544; 361/264, 265, 266, 302, 303; 123/143 A. 123/145 R, 145 A, 272; 338/240, 241, 269, 286, 338, 302; 29/614, 619

[56] References Cited

U.S. PATENT DOCUMENTS

| | | | |
|---|---|---|---|
| 1,738,026 | 12/1929 | Wennagel et al. | 338/241 |
| 2,030,937 | 2/1936 | Reichmann | 123/145 A |
| 2,508,512 | 5/1950 | Grinde | 338/241 X |
| 2,530,806 | 11/1950 | Boxrud et al. | 338/286 X |
| 2,730,597 | 1/1956 | Podolsky et al. | 338/302 X |
| 3,346,723 | 10/1967 | Mohn et al. | 219/553 |
| 3,393,038 | 7/1968 | Burkhalter et al. | 361/265 X |
| 3,454,345 | 7/1969 | Dyre | 361/265 X |
| 3,638,303 | 2/1972 | Mochizuki | 29/614 |
| 4,345,555 | 8/1982 | Oshima et al. | 123/145 A X |
| 4,357,526 | 11/1982 | Yamamoto et al. | 219/270 X |

FOREIGN PATENT DOCUMENTS

| | | | |
|---|---|---|---|
| 612533 | 4/1935 | Fed. Rep. of Germany | 123/145 A |
| 613426 | 5/1935 | Fed. Rep. of Germany | 123/145 A |
| 599233 | 10/1959 | Italy | 123/145 A |

*Primary Examiner*—Volodymyr Y. Mayewsky
*Attorney, Agent, or Firm*—Sughrue, Mion, Zinn Macpeak & Seas

[57] ABSTRACT

The heat generating member in a ceramic glow plug is a coil embedded in the ceramic. The coil is wound to have a coil angle, i.e. an angle formed between the coil and a line parallel to the coil axis, of no more than 60°. The ceramic may be a non-oxide ceramic, nitride ceramic, SiC ceramic, or the like.

9 Claims, 4 Drawing Figures

CERAMIC GLOW PLUG

This application is a continuation of application Ser. No. 335,422, filed Dec. 29, 1981, abandoned.

BACKGROUND OF THE INVENTION

The present invention relates to an improvement in a glow plug for use in a diesel engine to enhance the starting characteristics thereof.

Recently, glow plugs have been employed in which a heat conducting member is made of ceramic for rapid heating, and a heat generating element made of a durable metal, such as tungsten or the like, is formed on an inner surface of the heat conducting member by printing.

However, in a glow plug in which a heat generating element is merely printed, since the distribution and arrangement of the heat generating element in the heat conducting member are not uniform and are localized in some directions in order to reduce a heat generating rate, a thermal stress due to non-uniform rapid heating may cause parts of the printed heat generating elements to be cracked and damaged disadvantageously.

SUMMARY OF THE INVENTION

An object of the present invention is to provide a ceramic glow plug which overcomes the above noted defect and has an excellent durability and high reliability.

Briefly, this is achieved according to the present invention by embedding a coil of a material of heat resistive material such as tungsten or the like in a ceramic plug which is preferably of a non-oxide ceramic, a nitride ceramic, a SiC ceramic, or the like. The coil is wound at a pitch angle of 60° or less with respect to a line parallel to the coil axis.

BRIEF DESCRIPTION OF THE DRAWINGS

An embodiment of a glow plug according to the present invention will not be described with reference to the accompanied drawings, in which.

DETAILED DESCRIPTION OF THE INVENTION

Figure 1:
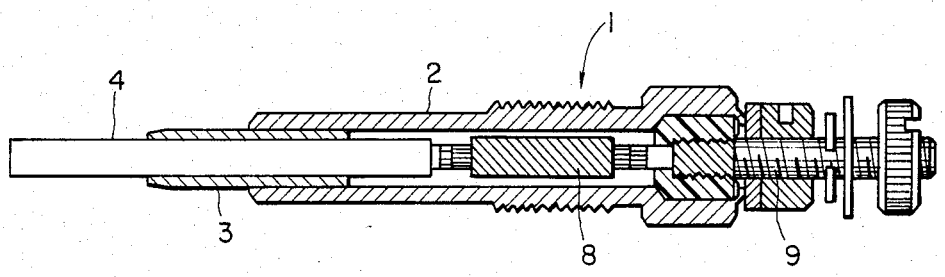
FIG. 1 is a longitudinal partial cross sectional view showing an embodiment of a ceramic glow plug according to the present invention.
Figure 2:
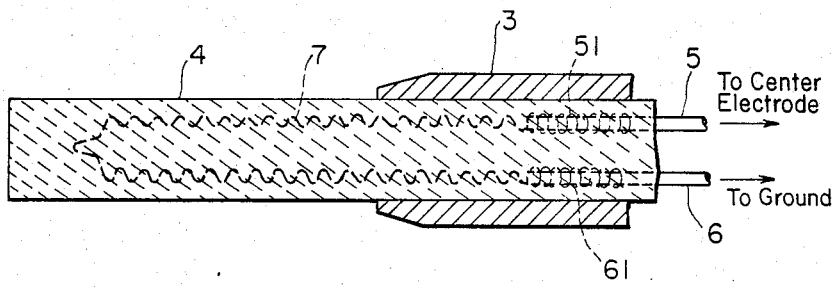
FIG. 2 is a partial enlarged cross sectional view of part of the glow plug shown in FIG. 1.
Figure 3:
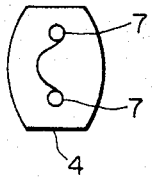
FIG. 3 is a partial front view of the glow plug shown in FIG. 1 which illustrates essential components of the glow plug which are embedded in a ceramic material.

In FIGS. 1 to 4, reference numeral 1 denotes a glow plug having a sheath body 2 provided at its front end with a heat conducting member 4 made of ceramic material such as a non-oxide ceramic, a nitride ceramic, a SiC ceramic or the like. In the heat conducting member 4, lead wires 5 and 6 extend parallel to a longitudinal axis of the heat conducting member 4 from the rear side of the heat conducting element 4. A heat generating element 7 is connected by compression heat bonding or the like to front end portions 51 and 61 of the lead wires 5 and 6, and is embedded in substantially a U-shape along the longitudinal axis of the heat generating element. It is preferable to make the heat generating element 7 of material having excellent heat resistive characteristics, such as tungsten or the like.

Either one of the above described lead wires 5 and 6 is electrically connected through a flexible wire 8 to a center electrode 9 which in turn is coupled to a positive electrode of a battery (not shown), for example. The other lead wire 6 is grounded to the sheath 2 through a protection tube 3.

Figure 4:
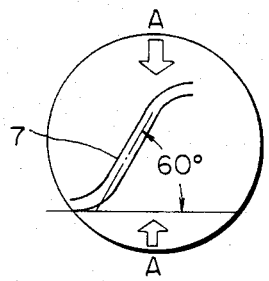
FIG. 4 is a partial enlarged side view for illustrating the coil pitch angle of the glow plug heat generating element.

The heat generating element 7 is shaped into the form of a coil 7. If the coil 7 is wound too tightly, compressive forces during the hot-pressing or sintering of the fabrication process may cause different parts of the coil to touch one another. Thus, it is preferable in the glow plug according to the present invention that the coil pitch angle, herein defined as the angle, when viewed from the side that the coil makes with a line parallel to the coil axis, be no more than 60°. This is illustrated in FIG. 4. In other words, the pitch of the coil is preferably increased to prevent damage to the coil during hot-pressing.

Further, if the coil is wound too tightly, compressive forces during hot-pressing, acting in the direction of the arrows in FIG. 4, will encounter significant resistance to compressing the coil but less resistance to compressing other parts of the plug. This may result in an uneven compression of the ceramic, which may in turn result in an uneven compression of the ceramic, cracking or other damage. This is also avoided by maintaining a coil pitch angle of 60° or less.

When the thus constructed glow plug 1 is installed in a diesel engine for starting the engine, and an electric current is applied to the glow plug to quickly heat the engine, since the heat generating element 7 is formed in a coil shape, the interior of the heat conducting member 4 is substantially uniformly heated. Therefore, the above described defect inherent in the prior art glow plug whereby thermal stress is caused by non-uniform heating is substantially eliminated, thereby preventing damage of the heat conducting member 4.

Also, the heat generating element 7 is wound so as to have a coil pitch angle of 60° or less as described above so that the density of the ceramic material of the heat conducting member 4 in the compression direction is uniform. Therefore, the mechanical strength of the heat conducting member 4 is enhanced and at the same time, the service life of the glow plug may be increased.

Thus, according to the present invention, the heat increasing property of the heat conducting member during heating may be stabilized and at the same time, by the enhancement of the mechanical strength of the ceramic material caused by the uniform density of the ceramic material, the durability and the reliability of the ceramic glow plug are increased.

What is claimed is:

1. A ceramic glow plug, comprising:

a ceramic heat conducting member;

a metal electrical heat generating element contained within said ceramic heat conducting member, said heat generating element comprising a metal coil having a coil pitch angle which does not exceed 60°, said coil pitch angle being defined as an angle formed between a line parallel to a longitudinal axis of said coil and turns of said coil, said coil forming a substantially U-shaped configuration having a pair of end portions and being embedded in said ceramic heat conducting member;

a pair of leads in said heat conducting member;

said heat generating element being electrically connected by compression heat bonding to front end portions of said leads:

a flexible wire connected to one lead at one end;

a center electrode connected to the other end of said flexible wire;

a sheath coupled to the other lead; and a protection tube surrounding said heat conducting member;

whereby after said coil is inserted into said heat conducting member, said heat conducting member, said leads and said coil are hot-pressed and subjected to compressive force to form said ceramic glow plug with said leads electrically coupled to said end portions.

2. A ceramic glow plug as claimed in claim 1, wherein said ceramic material is a non-oxide ceramic.

3. A ceramic glow plug as claimed in claim 2, wherein said ceramic material is a nitride ceramic.

4. A ceramic glow plug as claimed in claim 3, wherein said ceramic material is $Si_3N_4$.

5. A ceramic glow plug as claimed in claim 2, wherein said ceramic is SiC.

6. A ceramic glow plug as claimed in claim 1, wherein said heat generating element is made of tungsten.

7. A ceramic glow plug as claimed in claim 1 wherein said U-shaped coil has first and second parallel coil portions interconnected at an end thereof of each of the coil portions by a single coil turn having a longitudinal axis which is substantially perpendicular to a longitudinal axis of said first and second coil portions.

8. A ceramic glow plug, comprising:

a ceramic heat conducting member;

a metal electrical heat generating element contained within said ceramic heat conducting member, said heat generating member comprising a metal coil having a coil pitch angle which does not exceed 60°, said coil pitch angle being defined as an angle formed between a line parallel to a longitudinal axis of said coil and turns of said coil, said coil forming a substantially U-shaped configuration having a pair of end portions and being embedded in said ceramic heat conducting member;

first and second lead wires embedded in said heat conducting member and being wound onto said heat generating element, said heat generating element being connected by compression heat bonding to front end portions of said first and second lead wires;

a flexible wire connected to one lead wire at one end;

a center electrode connected to the other end of said flexible wire;

a sheath coupled to the other lead wire; and a protection tube surrounding said heat conducting wire;

said first lead wire being electrically connected through said flexible wire to said center electrode, said second lead wire being grounded to said sheath through said protection tube.

9. A ceramic glow plug as claimed in claim 8 wherein said U-shaped coil has first and second parallel coil portions interconnected at an end thereof of each of the coil portions by a single coil turn having a longitudinal axis which is substantially perpendicular to a longitudinal axis of said first and second coil portions.

* * * * *